US005240750A

United States Patent [19]

Cheng

[11] Patent Number: 5,240,750

[45] Date of Patent: Aug. 31, 1993

[54] DECORATIVE THREE-DIMENSIONAL, HEART-SHAPED BOW AND METHOD OF MAKING SAME

[76] Inventor: Peter S. C. Cheng, 5 Ross Street, Toronto, Ontario, Canada, M5T 1Z8

[21] Appl. No.: 857,512

[22] Filed: Mar. 25, 1992

[51] Int. Cl.[5] ..... D04D 7/10

[52] U.S. Cl. ..... 428/5; 28/147; 223/46; 428/136

[58] Field of Search ..... 428/4, 5, 133, 136; 223/46; 28/147, 148

[56] References Cited

U.S. PATENT DOCUMENTS

| | | | |
|---|---|---|---|
| 1,053,126 | 2/1913 | Fuller et al. | 428/5 X |
| 2,450,083 | 9/1948 | Donaldson | 428/40 |
| 2,681,525 | 6/1954 | James | 428/5 |
| 3,063,590 | 11/1962 | Hopkins | 428/5 X |
| 4,515,837 | 5/1985 | Cheng | 428/4 |
| 4,656,064 | 4/1987 | Cheng | 428/4 |
| 4,822,648 | 4/1989 | Cheng | 428/4 |
| 4,826,712 | 5/1989 | Theno | 428/4 |
| 4,840,822 | 6/1989 | Cheng | 428/4 |
| 4,900,632 | 2/1990 | McGrath | 428/542.8 |
| 4,915,996 | 4/1990 | Curry | 428/4 X |

*Primary Examiner*—Henry F. Epstein
*Attorney, Agent, or Firm*—Kirschstein, Ottinger, Israel & Schiffmiller

[57] ABSTRACT

A three-dimensional, heart-shaped, decorative bow has an elevated circular loop positioned above interconnected ends of a ribbon. The loop is formed by curling the ribbon in opposite directions, and is maintained in shape and in position by mutually interlocking slits formed in the ribbon.

13 Claims, 2 Drawing Sheets

DECORATIVE THREE-DIMENSIONAL, HEART-SHAPED BOW AND METHOD OF MAKING SAME

BACKGROUND OF THE INVENTION

1. Field of the Invention

This invention generally relates to a decorative three-dimensional, heart-shaped bow and a method of making same.

2. Description of Related Art

In the art of gift wrapping, it is desirable to provide a gift giver with esthetically pleasing decorations that are easy to apply on a gift or package so that the giver will readily utilize such decorations. The decorations should also be capable of being mass produced so as to bring down manufacturing costs and pricing without compromising the attractive appearance of the decorations.

Decorative ribbon bows formed by pulling a drawstring in situ on the gift or package, as exemplified by U.S. Pat. Nos. 4,515,837; 4,656,064 and 4,822,648, are known. Bows made by forming individual loops are known from U.S. Pat. Nos. 2,681,525 and 4,900,632. U.S. Pat. No. 4,840,822 discloses a netting bow for use as a gift wrapping product.

Although generally satisfactory for their intended purpose of decorating gift packages, the need persists for esthetically pleasing and unique decorative bows which are individualistic in appearance and yet produceable in large quantities and in a relatively short time so that the decorative bows are reasonably priced.

SUMMARY OF THE INVENTION

1. Objects of the Invention

It is a general object of this invention to overcome the aforementioned drawbacks of gift wrapping materials currently used.

It is another object of this invention to provide a new decorative bow which is inexpensive to manufacture on a mass-production basis.

Still another object of this invention is to provide a highly ornamental, individualistic and futuristic bow for adorning gifts and like objects.

Yet another object of this invention is to provide a novel method of making an ornamental bow.

2. Features of the Invention

In keeping with these objects, and others which will become apparent hereinafter, one feature of this invention resides, briefly stated, in a three-dimensional, heart-shaped decorative bow and a method of making the same.

The method includes the step of providing a flexible strip, e.g. a long, narrow ribbon, with a pair of longitudinal edges and a pair of opposite ends. At least one transverse slit is formed in the strip. The slit extends from one of the longitudinal edges toward, but terminates short of, the other of the longitudinal edges.

Thereupon, a closed loop is formed between the ends, preferably by imparting a twist to the strip. The strip ends are then overlapped and interconnected. Next, the strip is interlockingly received in said at least one slit at said other longitudinal edge. This maintains the loop in an elevated position above the interconnected ends.

In a preferred embodiment, another transverse slit is formed in the strip. The other slit extends from the other longitudinal edge toward, but terminates short of, the one longitudinal edge. The two slits interlockingly engage each other for an affirmative locking action.

The slits may be linearly formed perpendicularly of, or at an acute angle relative to, a respective longitudinal edge.

The finished bow has a three-dimensional configuration resembling a heart shape. The interconnected ends of the strip meet at a pointed end or cusp. The portions of the strip between the loop and the cusp are symmetrically curved. The bow is inexpensive to manufacture on a mass-production basis, is novel in appearance, and is especially suited for adorning gifts and like objects.

For this latter purpose, means are provided at the interconnected ends for attaching the bow to an object to be decorated. The attaching means includes a backing sheet, an adhesive layer on the backing sheet, and a peel-off tab over the adhesive layer. Upon removal of the tab, the adhesive layer can be pressed directly on the object and be adhered to the same.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
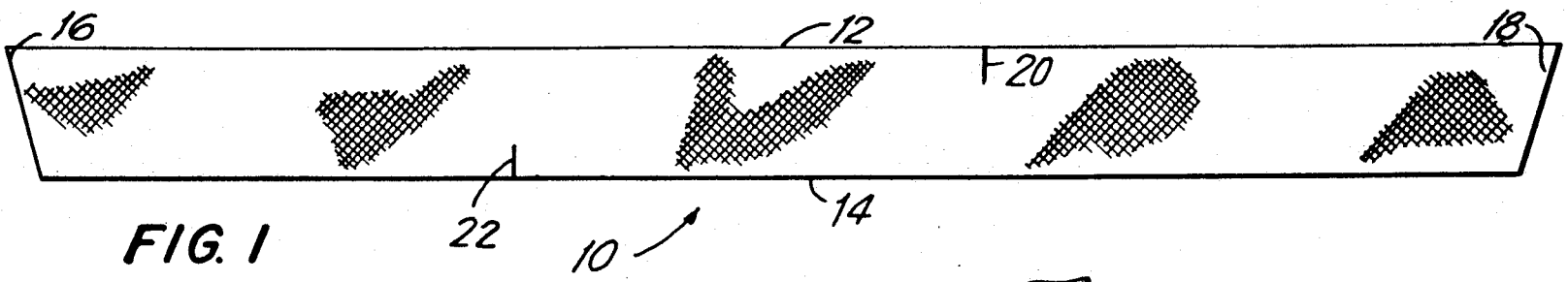
FIG. 1 is a top plan view of a planar strip prior to being formed into a three-dimensional, heart-shaped decorative bow according to this invention.

Referring to FIG. 1, reference numeral 10 generally identifies an elongated planar strip of flexible material extending along a longitudinal axis and constituted of paper, plastic, cloth, metal or the like. In the preferred embodiment, the strip 10 is a fibrous ribbon of synthetic material.

The strip 10 has a pair of longitudinal edges 12, 14 and a pair of ribbon ends or strip regions 16, 18. Each ribbon end is diagonally trimmed so that the strip has, as best seen in FIG. 1, a trapezoidal shape in top plan view.

At least one transverse slit, and preferably a pair of transverse slits 20, 22 are formed in the strip intermediate the ribbon ends 16, 18. Slit 20 extends linearly from edge 12 toward, but terminates short of, edge 14. Slit 22 extends linearly from edge 14 toward, but terminates short of, edge 12. The slits 20, 22 are spaced apart lengthwise along the strip, and preferably extend in mutual parallelism in a direction normal to the longitudinal axis of the strip. The slits could also be cut at respective acute angles relative to their respective longitudinal edges. The formation of the slits and the trimming of the ribbon ends can be successively performed, or preferably simultaneously performed in a stamping die.

Figure 2:
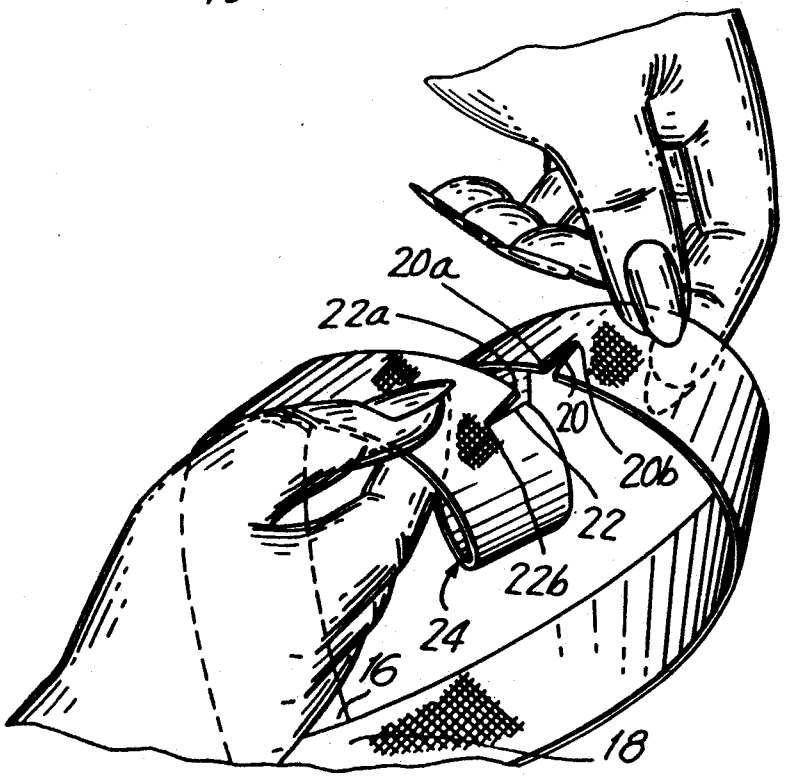
FIG. 2 is a perspective view of a preferred way of forming a loop in the strip of FIG. 1.

As shown in FIG. 2, a circular loop 24 is formed intermediate the ends 16, 18. The strip 10 is curled in opposite circumferential directions. The portion of the strip between slit 20 and end 18 is curled clockwise; the portion of the strip between slit 22 and end 16 is curled counter-clockwise.

The slits 20, 22 have mouths 20*a*, 22*a* on the edges 12, 14 which are opened during these curling movements. The slits 20, 22 have closed bottoms 20*b*, 22*b* within the strip. The slits 20, 22 are inserted, one into the other, until the bottoms engage each other. The slits thus interlockingly engage each other and insure that the circular loop 24 remains closed (see FIG. 3).

The ends 16, 18 are brought together, overlapped and interconnected, e.g. by glue, by staples 26, or analogous fastener. This interconnection of the ends may be performed either before or after the interlocking engagement of the slits.

Figure 3:
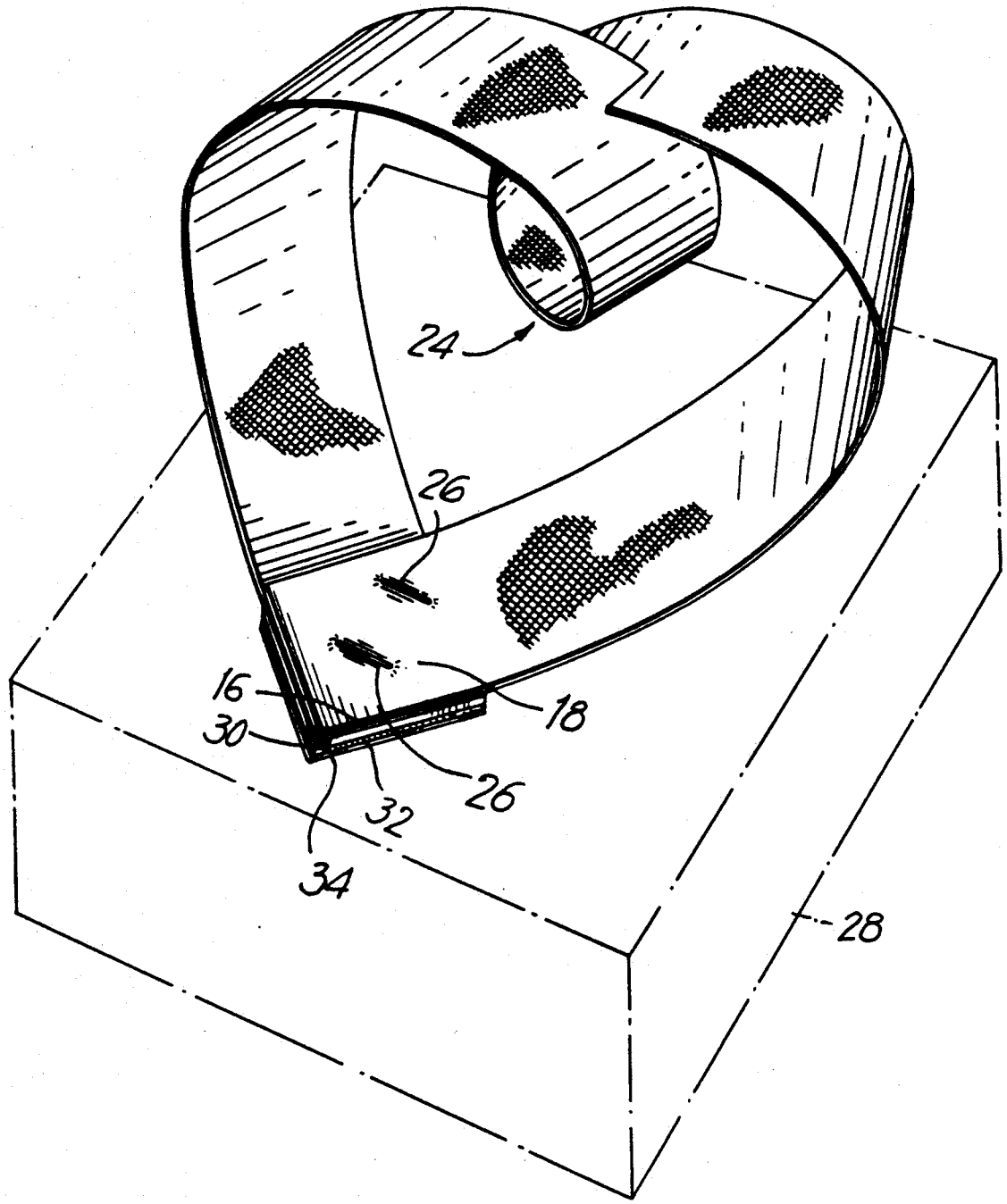
FIG. 3 is a perspective view of the completed bow, with its intended placement on an object being shown in phantom lines.

As shown in FIG. 3, the completed bow has its circular loop 24 elevated above the interconnected ends 16, 18. The trimmed ends 16, 18 resemble a heart cusp. The curling of the intermediate strip portions between the loop and the ends resembles heart-shaped curves. The affirmative interlocking action caused by the mutual reception of the slits 20, 22 insures that the loop 24 will maintain its elevated position and closed shape.

In a preferred application, the bow is attached to a gift, package or like object 28 (shown in phantom). To that end, a backing sheet 30 is connected to the ends 16, 18, preferably by the staples 26. A pressure-sensitive adhesive layer 32 is coated over the backing sheet 30. A peel-off tab 34 is releasably mounted over the adhesive layer 32.

The tab 34 remains in place until it is desired to adorn the object 28. Thereupon, the tab 34 is peeled off, and the exposed adhesive layer 32 is pressed against the object 28, thereby adorning the same.

It will be understood that each of the elements described above, or two or more together, also may find a useful application in other types of constructions differing from the types described above.

While the invention has been illustrated and described as embodied in a decorative three-dimensional, heart-shaped bow and method of making same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A three-dimensional, heart-shaped, decorative bow, comprising;

(a) a flexible strip having a pair of longitudinal edges, a pair of interconnected end regions overlapping each other at a common junction, and a loop remotely spaced from the junction between the interconnected end regions and located in an elevated position above the junction, said strip having at least one transverse slit extending from one of the longitudinal edges toward, but terminating short of, the other of the longitudinal edges, said at least one slit interlockingly receiving the strip at said other longitudinal edge to close said loop and to maintain said elevated position; and (b) means at said junction for attaching the bow to an object to be decorated.

2. The bow according to claim 1, wherein the strip is an elongated ribbon.

3. The bow according to claim 1, wherein the loop is circular.

4. The bow according to claim 1, wherein said at least one slit extends linearly and perpendicularly of said one longitudinal edge.

5. The bow according to claim 1, wherein the strip has another transverse slit extending from the other longitudinal edge toward, but terminating short of, said one longitudinal edge, and wherein the slits interlockingly engage each other.

6. The bow according to claim 5, wherein said slits extend in mutual parallelism linearly and perpendicularly of the respective longitudinal edges.

7. The bow according to claim 1, wherein the attaching means includes a backing sheet, an adhesive layer on the backing sheet, and a peel-off tab over the adhesive layer.

8. A method of making a three-dimensional, heart-shaped, decorative bow, comprising the steps of:

(a) providing a flexible strip with a pair of longitudinal edges and a pair of opposite end regions;

(b) forming in the strip at least one transverse slit which extends from one of the longitudinal edges toward, but terminating short of, the other of the longitudinal edges;

(c) forming a closed loop between the end regions;

(d) interconnecting the end regions by overlapping the end regions at a common junction; and (e) interlockingly receiving the strip in said at least one slit at said other longitudinal edge to maintain the loop in an elevated position above the junction.

9. The method according to claim 8, wherein the providing step is performed by forming the flexible strip as an elongated, generally planar ribbon.

10. The method according to claim 8, wherein the slit-forming step is performed by linearly slitting through the strip in a direction perpendicularly of said one longitudinal edge.

11. The method according to claim 8, wherein the loop-forming step is performed by curling the strip.

12. The method according to claim 8; and further comprising the step of forming in the strip another transverse slit which extends from the other longitudinal edge toward, but terminating short of, said one longitudinal edge.

13. The method according to claim 12, wherein each slit-forming step is performed by linearly slitting through the strip in a direction perpendicularly of a respective longitudinal edge.

* * * * *